US005707689A

United States Patent [19]

Hori

[11] Patent Number: 5,707,689

[45] Date of Patent: Jan. 13, 1998

[54] METHOD OF PAINTING BUILDING BOARDS

[75] Inventor: Shingo Hori, Nagoya, Japan

[73] Assignee: Nichiha Corporation, Nagoya, Japan

[21] Appl. No.: 690,829

[22] Filed: Aug. 1, 1996

[30] Foreign Application Priority Data

Nov. 29, 1995 [JP] Japan ..... 7-311084

[51] Int. Cl.[6] ..... B05D 5/00; B05D 1/02

[52] U.S. Cl. ..... 427/284; 427/421; 427/424; 427/426

[58] Field of Search ..... 427/421, 424, 427/426, 284; 118/698, 697, 314, 315

[56] References Cited

U.S. PATENT DOCUMENTS

| | | | |
|---|---|---|---|
| 4,129,671 | 12/1978 | Greenberg | 428/48 |
| 4,614,300 | 9/1986 | Falcoff | 239/71 |
| 4,979,380 | 12/1990 | Robbins et al. | 68/205 R |
| 4,984,169 | 1/1991 | Johnson, Jr. | 364/469 |
| 5,298,072 | 3/1994 | Schiele et al. | 118/681 |

FOREIGN PATENT DOCUMENTS

| | | | |
|---|---|---|---|
| 0116757 | 8/1984 | European Pat. Off. | D06B 11/00 |
| 61-197064 | 9/1986 | Japan | B05B 5/08 |
| 7-228036 | 8/1995 | Japan . | |

OTHER PUBLICATIONS

Japanese Patent abstract (JP 61–197064) by Kuribayashi et al., filed as application No. 60–35533 on Feb. 25, 1985, Jan. 23, 1987.

*Primary Examiner*—Shrive Beck
*Assistant Examiner*—Michael Barr
*Attorney, Agent, or Firm*—Foley & Lardner

[57] ABSTRACT

In a method of painting a building board by a computer-controlled painting machine so that colored paint patterns are formed on a surface of the building board, data is previously set regarding a colored paint pattern to be applied to a peripheral portion of the building board and stored in a memory of a computer. The peripheral portion of the board is painted on the basis of the data stored in the memory so that the paint of the color whose data is stored in the memory is applied to the peripheral portion of the building board. Random data is originated by the computer regarding a random colored paint pattern to be applied to a portion of the building board other than the peripheral portion. The data is previously set regarding the colored paint pattern to be applied to the peripheral portion of the building board, while various paint patterns are formed of the surface of the building board by a random pattern forming function of the computer. The paint colors at breaking joints of the building boards can be prevented from causing a sense of incompatibility which is caused by a conventional painting method.

2 Claims, 7 Drawing Sheets

METHOD OF PAINTING BUILDING BOARDS

BACKGROUND OF THE INVENTION

1. Field of the Invention

This invention relates to a method of painting building boards by a computer-controlled painting machine so that colored patterns are formed on surfaces of the building boards.

2. Description of the Prior Art

Methods have recently been proposed for increasing the variations in patterns formed on a surface of a building board by painting. For example, publication No. 7-228036 of a Japanese unexamined patent application discloses a method in which a computer is used to automatically originate data of random paint patterns and a building board is painted in accordance with the painting patterns so that randomly colored patterns are formed on the surface of the building board.

In the above-described painting method, however, the paint patterns are rendered random on the entire surface of the building board. As a result, on one hand, when a plurality of building boards 1 are laid on a wall surface in a manner as shown in FIG. 7, peripheral convex pattern blocks of one board 1 are discontinuous at breaking joints 2 such that colors of the blocks are different from those of convex pattern blocks of the adjacent boards 1, although the blocks should originally be continuous. This discontinuity of the convex pattern blocks results in unnaturalness. On the other hand, when straight joint brick-like and tile-like paint patterns are randomly set as shown in FIG. 8, the paint patterns of two building boards 3, which should originally be random, become similar at a breaking joint 4 of the boards 3. Thus, the randomicity of the paint patterns is reduced, which results in a sense of incompatibility.

SUMMARY OF THE INVENTION

Therefore, an object of the present invention is to provide a method of painting building boards wherein the colors of the peripheral pattern blocks at the breaking joint of the boards do not result in a sense of incompatibility, and the breaking joints of the boards can unconsciously be viewed such that a fine wall surface finishing can be provided.

To achieve the object, the present invention provides a method of painting a building board by a plurality of computer-controlled ink jet painting machines so that colored paint patterns are formed on a surface of the building board. Each ink jet painting machine includes a number of spray nozzles disposed over a conveyor for conveying the building board, so as to cross a direction of conveyance of the conveyor and valves for opening and closing the respective spray nozzles. The ink jet painting machines are supplied with paints of different colors from one another respectively. The method comprises the steps of previously setting data of a colored paint pattern to be applied to a peripheral portion of the building board and storing the data in a memory of a computer, and painting the peripheral portion of the building board by controlling the valves of the ink jet painting machines on the basis of the data stored in the memory so that the colored paint pattern whose data is stored in the memory is applied to the peripheral portion of the building board. The method further comprises the steps of originating by the computer random data of a colored paint pattern to be applied to a portion of the building board other than the peripheral portion, and painting the portion of the building board other than the peripheral portion by controlling the valves of the ink jet painting machines on the basis of the originated random data so that the random colored paint pattern whose data has been originated by the computer is applied to the portion of the building board other than the peripheral portion.

According to the above-described method, the data is previously set regarding the colored paint pattern to be applied to the peripheral portion of the building board and stored in the memory of the computer, while various paint patterns are formed on the surface of the building board by a random pattern forming function of the computer. Consequently, the colored paint patterns at the breaking joint of the building board can be prevented from causing a sense of incompatibility which is caused by the conventional painting method.

In the above-described method, the plurality of ink jet painting machines are preferably provided over the conveyor. Each of the painting machines includes a number of spray nozzles arranged to cross the conveyor, and valves opening and closing the respective spray nozzles are preferably controlled by the computer. Consequently, random colored paint patterns can efficiently be formed on the surfaces of the building boards at a painting line in a factory.

BRIEF DESCRIPTION OF THE DRAWINGS

Other objects, features and advantages of the present invention will become clear upon reviewing the following description of preferred embodiments thereof, made with reference to the accompanying drawings, in which.

DETAILED DESCRIPTION OF THE PREFERRED EMBODIMENTS

Figure 1:
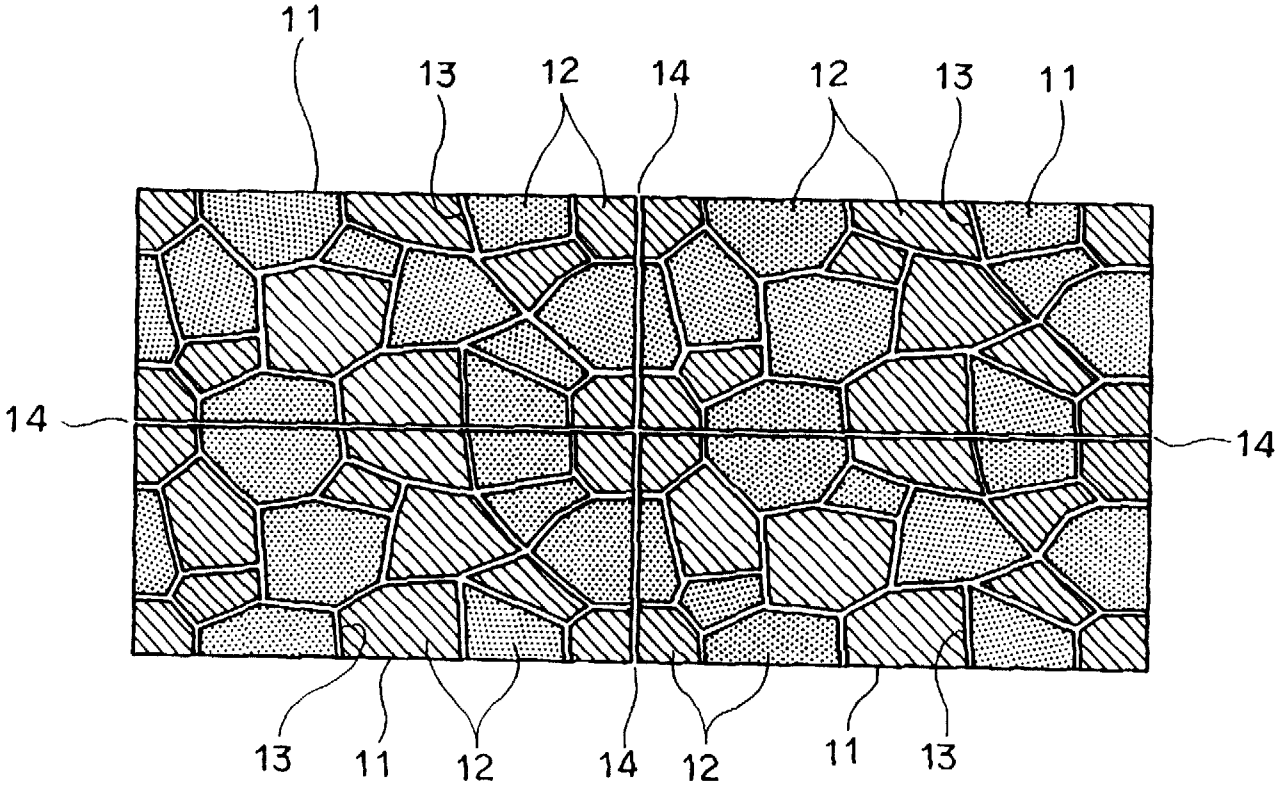
FIG. 1 is a front view of building boards painted according to a first embodiment of the method in accordance with the present invention.
Figure 2:
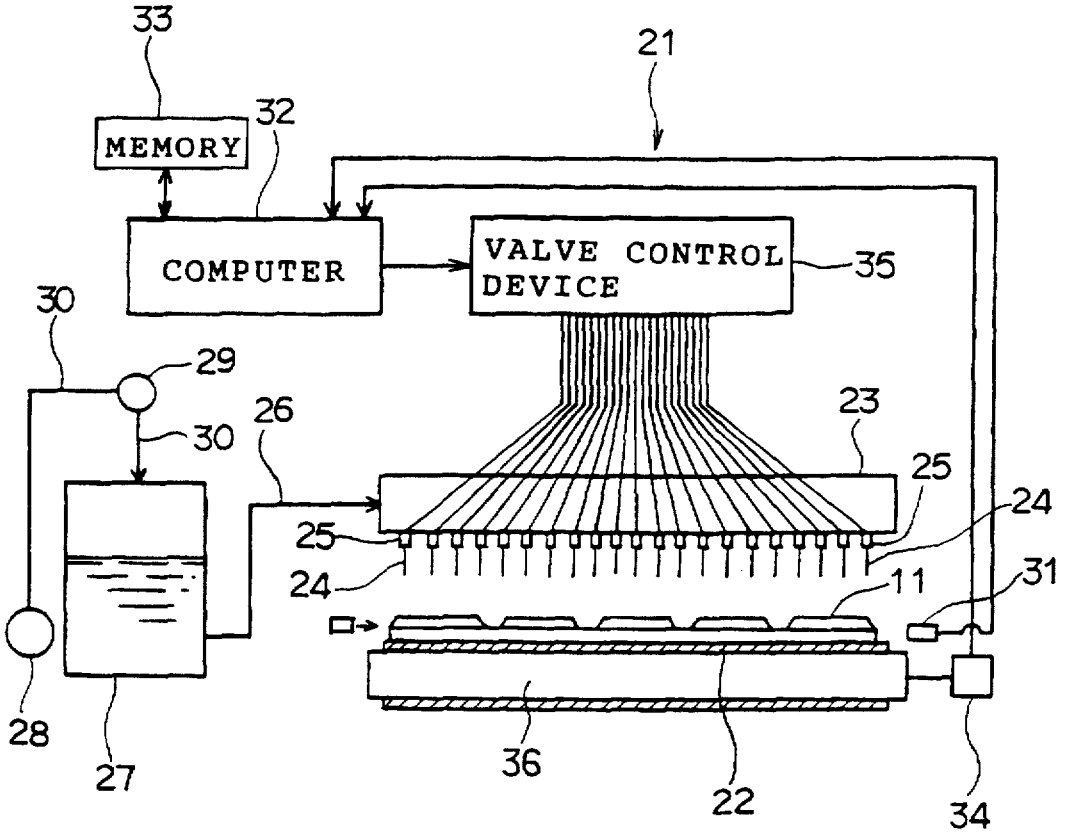
FIG. 2 is a front view of an ink jet painting machine.
Figure 3:
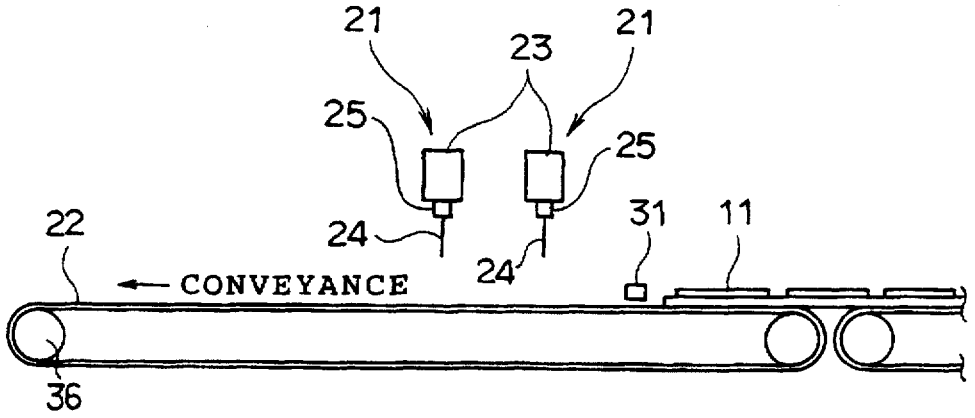
FIG. 3 is a side view of the ink jet painting machine.

A first embodiment of the present invention will be described with reference to FIGS. 1 to 3. A building board 11 will first be described with reference to FIG. 1. The building board 11 is formed by pressing a forming material of cement system by the use of a template (not shown). The building board 11 has on its surface concave and convex patterns in which various configurations of convex pattern blocks 12 each formed into the sizes of natural stones are arranged with decorative joints 13 surrounding the blocks. The convex pattern blocks 12 and the decorative joints 13 in each of side portions of the building board 11 are formed so as to be continuous to those of other adjacent building boards 11 when a plurality of building boards 11 are fixed to or laid on a wall surface. More specifically, the convex pattern blocks 12 and the decorative joints 13 in the lower side portion of each building board 11 are formed to be continuous to those in the upper side portion of each building board 11, and the convex pattern blocks 12 and the decorative joints 13 in the left-hand side portion of each building board 11 are formed to be continuous to those in the right-hand side portion of each building board, as viewed in FIG. 1.

A surface of the building board 11 is painted so that the convex pattern blocks 12 have different colors and so that the convex pattern blocks 12 in a peripheral portion of the board 11 have the same colors as those of the other boards 11 continuous to them with joints 14 being formed therebetween. Data of colored paint patterns applied to the peripheral portion of the board 11 is previously set so as to achieve the above-described color arrangement. Regarding the convex pattern blocks 12 in a portion of the board 11 other than the peripheral portion, random data of colored paint patterns is originated by the use of a random number generating function of a computer 32 (see FIG. 2) so that various types of paint patterns are formed on the surface of the board 11. The decorative joints 13 are painted so as to have colors different from those of the convex pattern blocks 12.

The construction of an ink jet painting machine 21 used for painting the board 11 will now be described with reference to FIG. 2. A painting header 23 is disposed over a conveyor 22 provided for conveying the building boards 11. A number of spray nozzles 24 are mounted on valves 25 respectively to be directed downwardly, the valves 25 being further mounted on the underside of the painting header 23. The spray nozzles 24 are arranged in a row extending in the direction of width of the board 11 or in the direction crossing the direction of conveyance of the conveyor 22 so that the spray nozzles 24 cover the entire width of the board 11. The painting header 23 is connected via a paint supply pipe 26 to a lower portion of a paint tank 27. An air supply pipe 30 is connected to a compressor 28 and across a regulator 29 to an upper portion of the paint tank 27. The air supply pipe 30 supplies low-pressure air from the compressor 28 to the paint tank 27 with the air being pressure-regulated by the regulator 29. The low-pressure air supplied into the paint tank 27 force feeds a paint reserved therein through the paint supply pipe 26 into the painting header 23. The paint thus fed to the painting header 23 is injected from the spray nozzles 24 onto the surface of the building board 11.

Two ink jet painting machines 21 as described above are provided as shown in FIG. 3 when two colors of convex pattern blocks 12 are to be formed on the surface of the building board 11. The painting machines are provided for the different colors of paints. All the convex pattern blocks 12 are formed on the surface of the board 11 in two painting steps. Three or more ink jet painting machines 21 are provided when three or more colors of convex pattern blocks 12 are to be formed on the surface of the building board 11. All the convex pattern blocks 12 are formed in the painting steps whose number corresponds to that of the painting machines.

The building board 11 is detected by a photoelectric sensor 31 when a front end of the board reaches a predetermined position immediately before a painting starting position. A detection signal generated by the photoelectric sensor 31 is input to the computer 32 for controlling painting. The computer 32 controls the above-mentioned painting machines 21 so that colored paints are applied to the surface of the building board 11. The computer 32 includes a memory 33 storing data of peripheral portion paint patterns previously set so that the blocks 12 to be formed on the surface of one board 11 have the same color as the blocks of the other boards 11 continuous to those of said one board 11 with the joint 14 being interposed therebetween.

The computer 32 starts a random number generating routine every time the painting of one building board 11 is completed, thereby originating random data of colored paint patterns to be applied to the portion of the board 11 other than the peripheral portion thereof. The originated random data of paint patterns is stored in the memory 33. Accordingly, in the painting, the peripheral portion paint pattern data previously set and stored in the memory 33 and the random paint pattern data originated by the computer 32 are synthesized into a paint pattern data for one building board 11.

Upon input of the detection signal from the photoelectric sensor 31, the computer 32 counts pulse signals delivered by an encoder 34 mounted on a drive roller 36 of the conveyor 22. Control signals are delivered to a valve control device 35 in accordance with the painting pattern data stored in the memory 33 in synchronism with the pulse signals when a counted value reaches a predetermined value or when the front end of the board 11 reaches the painting starting position. The opening timings of the valves 25 connected to the respective spray nozzles 24 and accordingly, the timing of paint injection are separately controlled by the delivered control signals so that the convex pattern blocks 12 are formed on the surface of the board 11.

Prior to the above-described painting step, a sealer is applied to the entire surface of the board 11 so that a sealer film is formed thereon. Furthermore, an under coat such as flow coater is applied on the sealer film. The under coat is also applied to the decorative joints 13. Thus, the color of the decorative joints 13 depends upon the under coat. Subsequently, an intermediate coat is applied only to the convex pattern blocks 12 on the surface of the board 11 by a roll coater. Subsequently, a top coat is applied to the convex pattern blocks 12 by the ink jet painting machine 21 so that random paint blocks are formed thereon.

Figure 7:
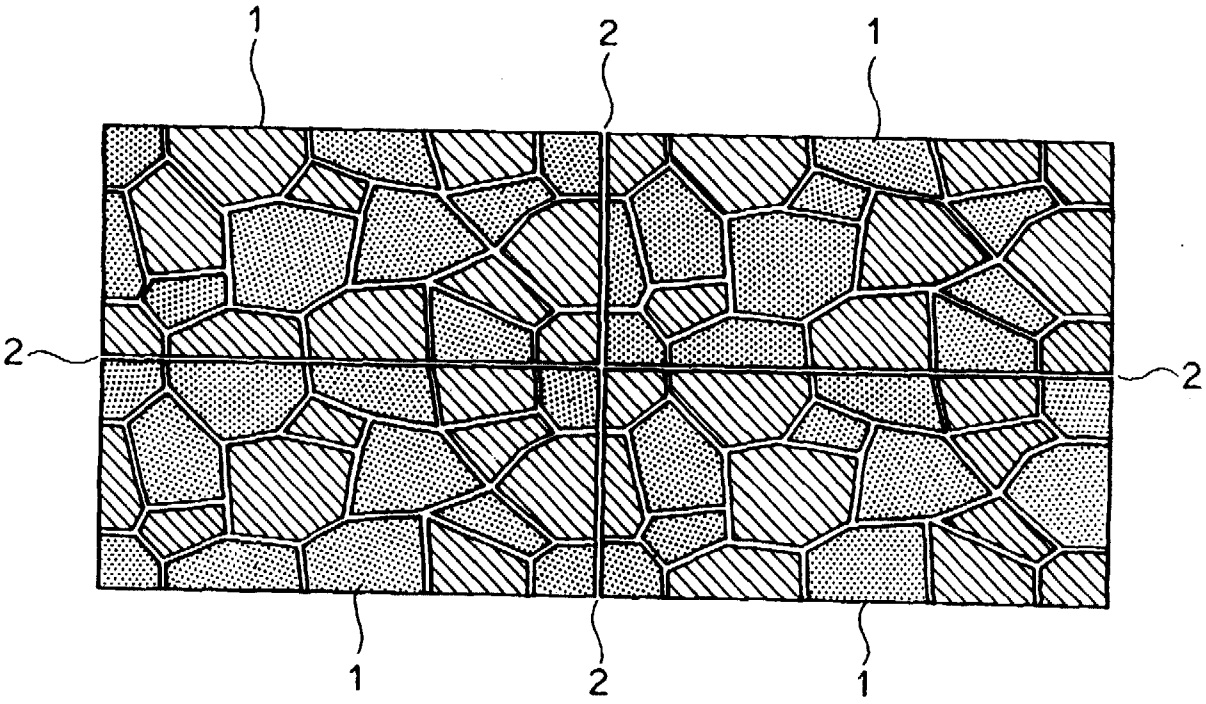
FIG. 7 PRIOR ART
FIG. 7 is a front view of building boards painted according to a conventional method.

According to the first embodiment, the data is previously set regarding the colored paint pattern to be applied to a peripheral portion of the building board 11, while various paint patterns are formed on the surface of the building board 11 by a random pattern forming function of the computer 32. Thus, the convex pattern blocks 12 of one building board 11 have the same colors as those of the other boards 11 continuous to them with the joints 14 being formed therebetween when a plurality of boards 11 are fixed to or laid on the wall surface. Consequently, the paint colors at the breaking joint of the building board can be prevented from causing the sense of incompatibility which is caused by the conventional painting method as shown in FIG. 7. Accordingly, the breaking joints 14 of the boards 11 can unconsciously be viewed such that a fine wall surface finishing can be provided.

Figure 4:
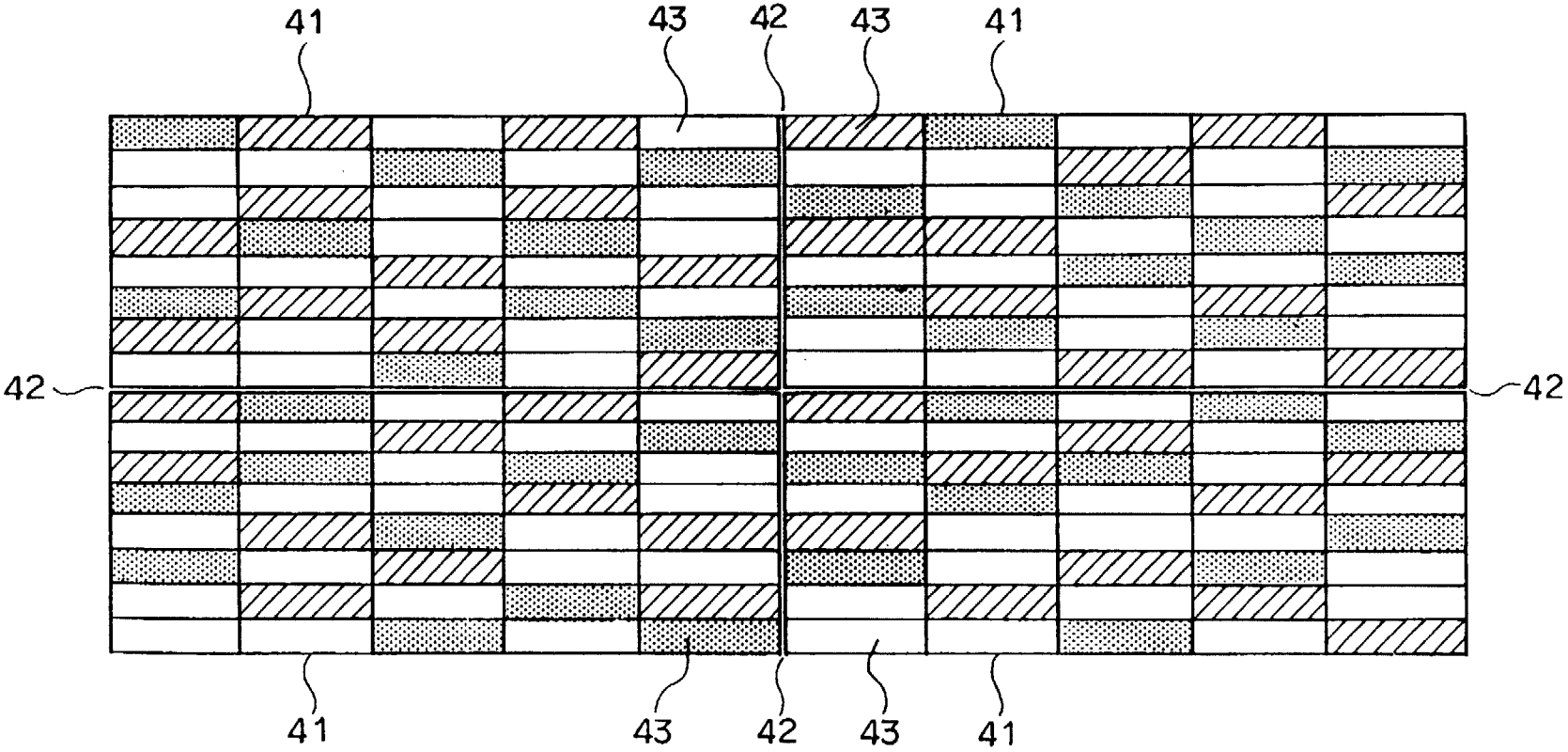
FIG. 4 is a front view of building boards painted according to a second embodiment of the method in accordance with the present invention.
Figure 8:
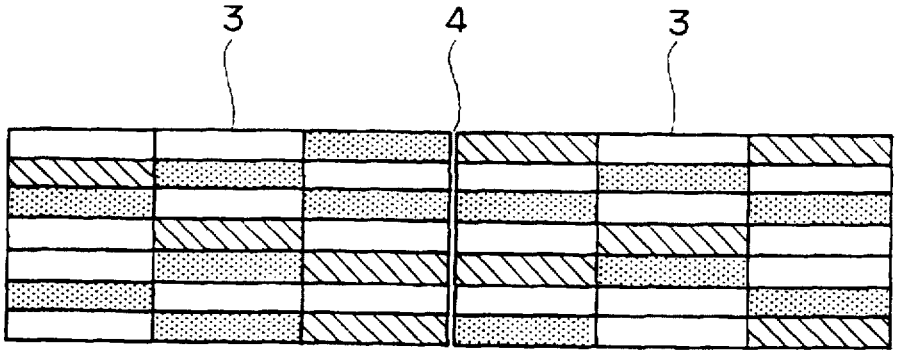
F I G. 8 PRIOR ART
FIG. 8 is a front view of building boards painted according to another conventional method.

FIG. 4 shows a second embodiment of the present invention. In the second embodiment, straight joint brick-like and tile-like concave and convex paint patterns are formed on the surface of the building board 41. In these patterns, the paint patterns at both sides of the breaking joint 42 become similar to each other when an increasing number of convex pattern blocks 43 of one board 41 have the same colors as those of the adjacent boards 41 at breaking joints of the boards 41. Consequently, the randomicity of the paint patterns, which should originally be random, is reduced, which results in a sense of incompatibility. See FIG. 8.

In view of the above-described problem, in the second embodiment, data is previously set regarding a colored paint pattern to be applied to a peripheral portion of the building board 41 and stored in the memory 33 of the computer 32 so that an increasing number of convex pattern blocks 43 of one board 41 do not have the same colors as those of the adjacent boards 41 at breaking joints of the boards 41. Furthermore, random data of colored paint pattern is originated by the computer 32 regarding the portion of the board 41 other than the peripheral portion so that various paint patterns are formed on the surface of the board 41.

Figure 5:
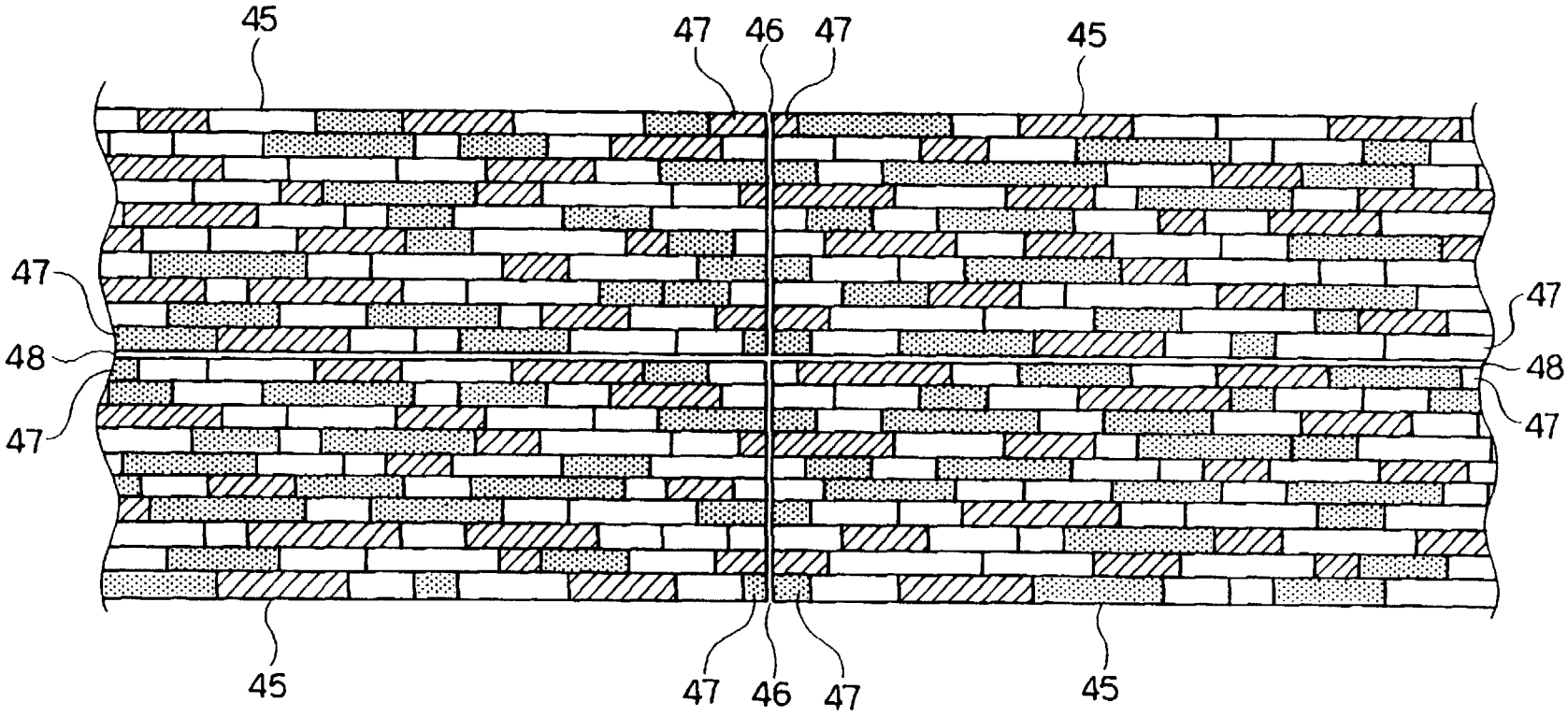
FIG. 5 is a front view of building boards painted according to a third embodiment of the method in accordance with the present invention.

FIG. 5 illustrates a third embodiment of the present invention. In the third embodiment, broken and rubbled stone-like concave and convex paint patterns with a breaking joint are formed on the surface of the building board 45. In these patterns, the convex pattern blocks 47 of one board 45 are continuous to those of the adjacent boards 45 at left-hand and right-hand side breaking joints 46. When these convex pattern blocks 47 at both sides of the breaking joint 46 have different colors, the blocks become discontinuous, which results in a sense of incompatibility. Furthermore, the randomicity of the paint patterns is reduced with a result of a sense of incompatibility when an increasing number of convex pattern blocks 47 of an upper board 45 have the same colors as those of a lower board 45 at the breaking joint 48 of the boards 45.

In view of the above-described problems, in the third embodiment, data is previously set regarding colored paint pattern to be applied to a peripheral portion of the building board 45 and stored in the memory 33 of the computer 32 so that the peripheral convex pattern blocks 47 of the left-hand board 45 have the same colors as those of the right-hand board 45 at the breaking joint 46 and so that the peripheral convex pattern blocks 47 of the upper board 45 have colors different from those of the lower board 45 at the breaking joint 48 as much as possible. Furthermore, random data of a colored paint pattern is originated by the computer 32 regarding the portion of the board 45 other than the peripheral portion so that various paint patterns are formed on the surface of the board 45.

Figure 6:
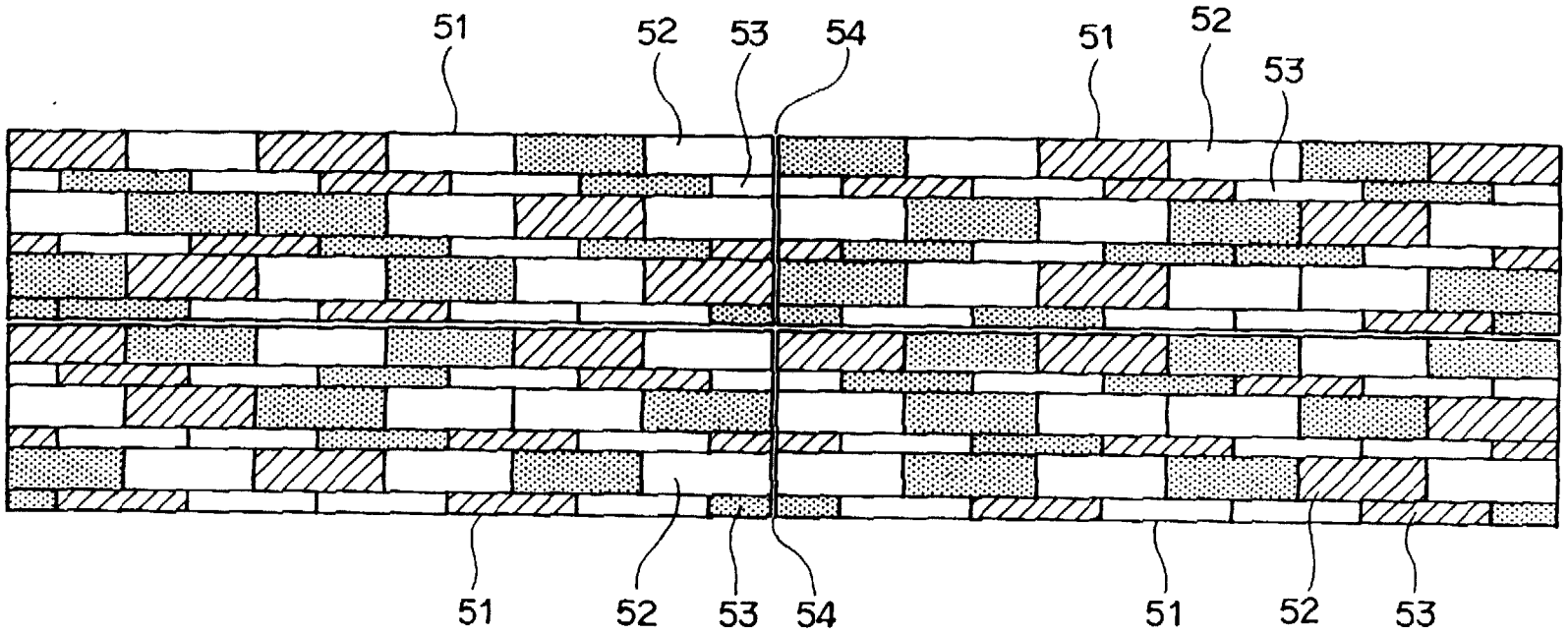
FIG. 6 is a front view of building boards painted according to a fourth embodiment of the method in accordance with the present invention.

FIG. 6 illustrates a fourth embodiment of the present invention. In the fourth embodiment, broken and rubbled stone-like concave and convex paint patterns with a breaking joint are formed on the surface of the building board 51. In these patterns, blocks 52 each having a large width and blocks 53 each having a small width are alternately arranged.

In the fourth embodiment, blocks 53 of the left-hand board 51 having the small width are continuous to those of the right-hand board 51 at a breaking joint 54. An excessive number of blocks of the same colors would be located at the breaking joint 54 with a result of a sense of incompatibility when the blocks 53 of the left-hand board 51 have the same colors as those of the right-hand board at the breaking joint 54 and blocks 52 of the left-hand board 51 having the large width have also the same colors as those of the right-hand board 51 at the breaking joint 54. Accordingly, data is previously set regarding colored paint pattern to be applied to a peripheral portion of the building board 51 and stored in the memory 33 of the computer 32 so that the peripheral blocks 53 of the left-hand board 51 having the small width have the same colors as those of the right-hand board 51 at the breaking joint 54 and so that the peripheral blocks 52 of the left-hand board 51 have colors different from those of the right-hand board 51 at the breaking joint 54. Furthermore, random data of colored paint pattern is originated by the computer 32 regarding the portion of the board 51 other than the peripheral portion so that various paint patterns are formed on the surface of the board 51.

Although the invention is applied to a lateral building board in the foregoing embodiments, a longitudinal building board may be used instead. Furthermore, paint patterns formed on the surface of the building board should not be limited to the concave and convex paint patterns described above. The invention may be applied to building boards with various paint patterns.

The foregoing description and drawings are merely illustrative of the principles of the present invention and are not to be construed in a limiting sense. Various changes and modifications will become apparent to those of ordinary skill in the art. All such changes and modifications are seen to fall within the true spirit and scope of the invention as defined by the appended claims.

What is claimed is:

1. A method of painting a building board by a plurality of computer-controlled ink jet painting machines so that colored paint patterns are formed on a surface of the building board, so that when aligned with other building boards, said building boards form a continuous pattern, and each ink jet painting machine including a number of spray nozzles disposed over a conveyor for conveying the building board, so as to cross a direction of conveyance of the conveyor and valves for opening and closing the respective spray nozzles, the ink jet painting machines being supplied with paints of different colors from one another respectively, the method comprising the steps of:

setting data corresponding to a colored paint pattern to be applied to a peripheral portion of the building board and storing the data in a memory of a computer;

painting the peripheral portion of the building board by controlling the valves of the ink jet painting machines on the basis of the data stored in the memory so that the colored paint pattern whose data is stored in the memory is applied to the peripheral portion of the building board;

originating by the computer random data of a random colored paint pattern to be applied to a portion of the building board other than the peripheral portion; and painting the portion of the building board other than the peripheral portion by controlling the valves of the ink jet painting machines on the basis of the originated random data so that the random colored paint pattern whose data has been originated by the computer is applied to the portion of the building board other than the peripheral portion.

2. A method of painting a plurality of building boards so that when aligned with each other, said plurality of building boards form a continuous pattern, said method comprising:

setting data corresponding to a predetermined colored paint pattern to be applied to a peripheral portion of a building board and storing the data in a memory of a computer;

painting the peripheral portion of the building board using at least one painting machine by controlling the painting machine based on said data stored in the memory so that the colored paint pattern whose data is stored in the memory is applied to the peripheral portion of the building board;

originating random data corresponding to a random colored paint pattern to be applied to a portion other than said peripheral portion of the building board; and painting the said portion of the building board other than the peripheral portion by controlling the painting machine based on the originated random data so that the random colored paint pattern whose data has been originated by the computer is applied to the portion of the building board other than the peripheral portion.

* * * * *